United States Patent [19]

Fujii et al.

[11] Patent Number: 4,608,003

[45] Date of Patent: Aug. 26, 1986

[54] SEAL ARRANGEMENT FOR VANE TYPE AIR PUMPS

[75] Inventors: Isao Fujii; Shin Narasaka, both of Saitama, Japan

[73] Assignee: Honda Giken Kogyo Kabushiki Kaisha, Tokyo, Japan

[21] Appl. No.: 657,684

[22] Filed: Oct. 4, 1984

[30] Foreign Application Priority Data

Oct. 12, 1983 [JP] Japan ..... 58-190474

[51] Int. Cl.[4] ..... F04C 18/00; F04C 27/00

[52] U.S. Cl. ..... 418/137

[58] Field of Search ..... 418/137, 241, 122, 136; 277/81 R, 81 P

[56] References Cited

U.S. PATENT DOCUMENTS 1,695,650 12/1928 Godillot ..... 418/137
2,027,972 1/1936 Haller et al. ..... 418/137
3,161,350 12/1964 Lorcher ..... 418/122

FOREIGN PATENT DOCUMENTS 822640 9/1937 France ..... 418/122
1440267 6/1976 United Kingdom ..... 418/137

*Primary Examiner*—John J. Vrablik
*Attorney, Agent, or Firm*—Lyon & Lyon

[57] ABSTRACT

A vane type pump having a rotor with slots through which vanes extend and engage the inside of a cylindrical casing to pump upon rotation of the rotor. The slots have a longitudinal groove on each inner side facing each other and elongated carbon sealing elements are positioned in the grooves to sealably engage the vane extending therebetween. A leaf spring is positioned behind one sealing element in compression and its amplitude of movement, as a result of the dimensions of all the components, is limited to 0.6 mm or less.

3 Claims, 5 Drawing Figures

SEAL ARRANGEMENT FOR VANE TYPE AIR PUMPS

The present device relates to a vane type air pump and, in particular, to an improved construction of the seal arrangement on the vane to reduce possibility of sealing element damage and improve performance.

A typical conventional vane type air pump, such as the pump disclosed in U.S. Pat. No. 3,356,292 for use on automotive engines, is constructed of a cylindrical casing and a cylindrical rotor which has its rotational center line eccentric to the center line of the casing and vanes extending through slots formed in the circumferential wall of the rotor and parallel with the rotational center line. The leading ends of the vanes engage the inner circumference of the casing in a manner to slide in the circumferential direction and there are rod-shaped seal elements on both inner sides of the slots extending longitudinally of the slots to contact both sides of the vanes. A leaf spring is provided either in only one of the slots, as shown in U.S. Pat. No. 3,356,292, or in both of the slots, as shown in U.S. Pat. No. 2,625,112, for resiliently urging the seal elements into engagement with the vane. The seal elements are usually made of carbon and as a result are rather brittle.

When the aforementioned air pump having a single leaf spring located behind the seal element on the side in the direction of rotation reaches its high-speed r.p.m. range, the pressure difference between the rotational leading and trailing sides of the vane and the centrifugal force of the vane develops a high impact force which is exerted upon the seal element that is elastically supported by the leaf spring at the instant when the vane passes the entrance of the discharge chamber.

In order to dampen that impact, the leaf spring is compressed and deformed to lower its crest. If the amplitude of the leaf spring is large, however, the moving stroke of the first seal element is enlarged which increases the impact applied to the first seal element. Under such conditions, the first seal element may be broken due to its low mechanical strength since it is pressure-molded of carbon powder.

It is an object of the present invention to provide an air pump of the aforementioned type which has its seal elements arranged to avoid being broken and its pumping efficiency improved by restricting the amplitude of the leaf spring and, therefore, the possible movement of the seal element.

Other and more detailed objects will be apparent from the following description of the present device in connection with preferred embodiment thereof with reference to the accompanying drawings.

Figure 1:
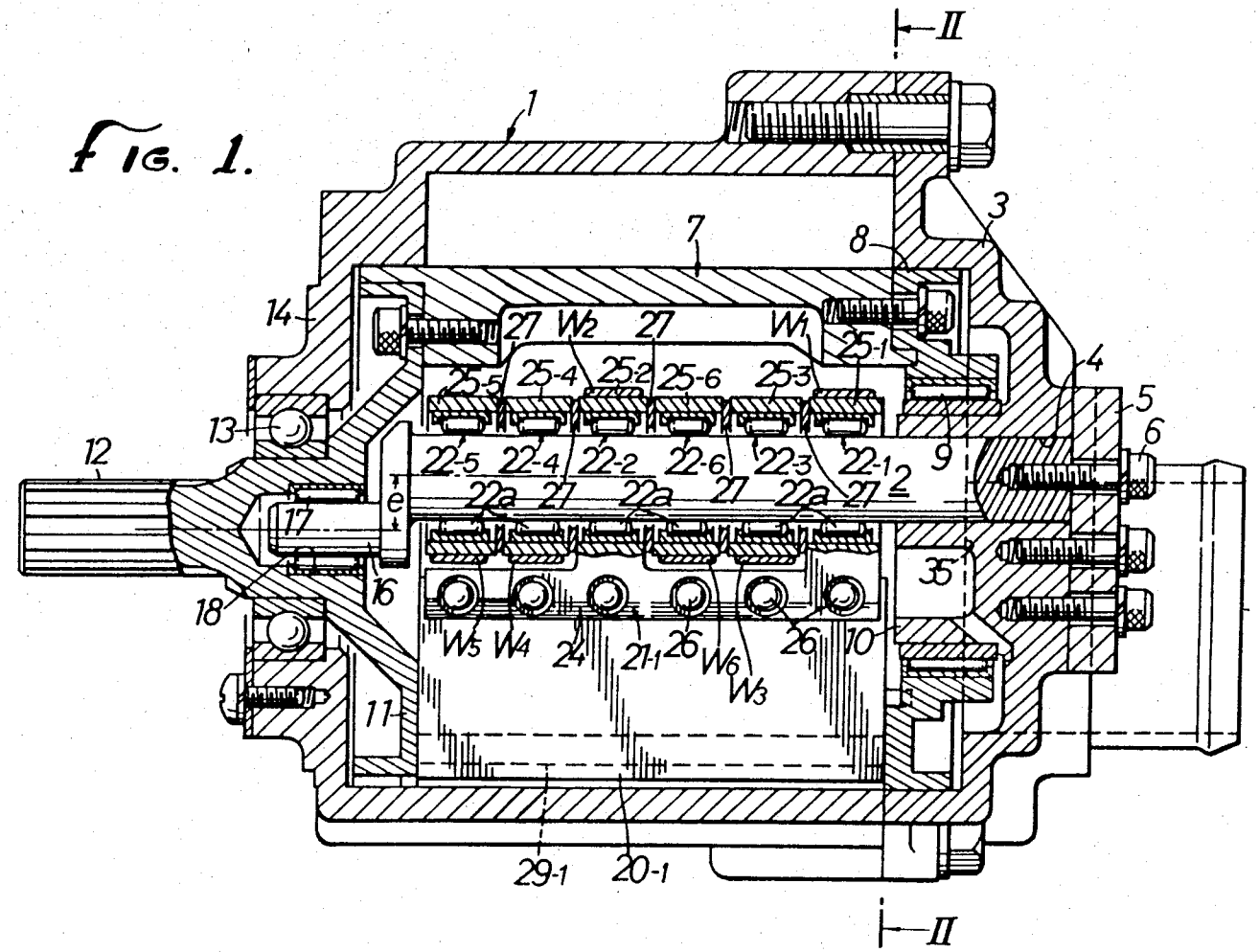
FIG. 1 is a longitudinal sectional side elevation of a vane type air pump in which the improved vane seal arrangement of this invention may be used.
Figure 2:
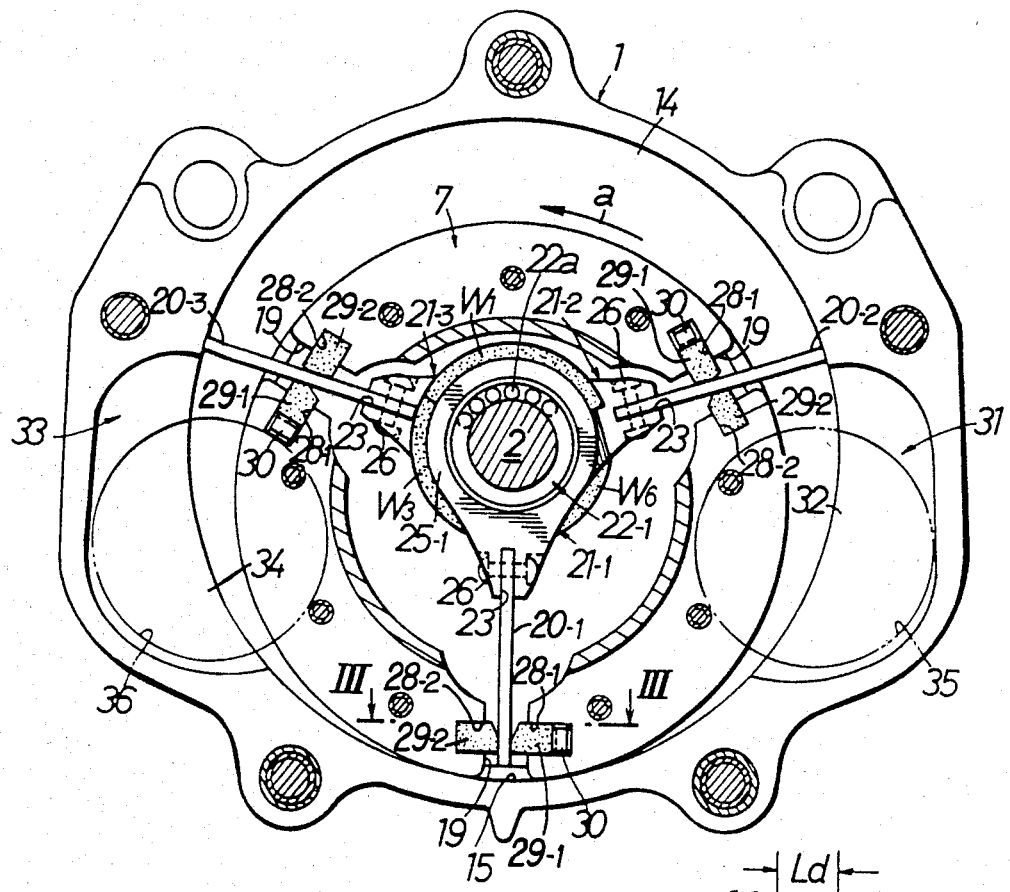
FIG. 2 is a sectional end view of the vane type air pump taken substantially on the line II—II shown in FIG. 1.

As shown in FIGS. 1 and 2, there is arranged in a cylindrical casing 1 a vane shaft 2 which has its axis aligned with the center line of the casing 1. The vane shaft 2 is fitted rotatably and axially immovably in the casing 1 by inserting one end of the shaft 2 in a through hole 4, which is formed in one end wall 3 of the casing 1, and by bolts 6 which extend through a cover plate 5 fixed on the outer side of that end wall 3 and onto one end of the vane shaft 2.

In the casing 1 there is arranged a cylindrical rotor 7 which encloses the vane shaft 2. One annular end wall 8 of the rotor 7 is rotatably borne by means of a bearing 9 on the boss 10 of the end wall 3 of the casing 1. A drive journal 12 protruding from the other end wall 11 of the rotor 7 is borne by a bearing 13 in the other annular end wall 14 of the casing 1. The drive journal 12 is connected through a not-shown transmission to an engine so that it can rotate the rotor 7 in the direction of arrow a of FIG. 2.

The rotor 7 has its rotational center line made eccentric by a distance e from the center line of the casing 1 so that its outer circumference is partially in sliding contact with a land 15 of the inner circumference of the casing 1 at all times. The other end portion 16 of the vane shaft 2 is offset to have its end borne through a bearing 17 in a bearing hole 18 which is formed in the drive journal 12 of the rotor 7.

The circumferential wall of the rotor 7 is formed with three slots 19 which are equidistantly spaced from one another and elongated in parallel with the rotational center line of the rotor 7 and through which are extended first to third vanes 20-1 to 20-3, respectively. The legs of the individual vanes 20-1 to 20-3 are held in first to third holders 21-1 to 21-3, which are rotatably borne on the vane shaft 2 through needle bearings 22-1 to 22-6.

The first and third holders 21-1 and 21-3 are made to have similar shapes and are provided with bifurcated rods 24, which are formed with slots 23, and one pair of cylindrical bearing retainers 25-1 and 25-2, and 25-5 and 25-6 which are formed to project from the one-end and intermediate portions thereof. The legs of the first and third vanes 20-1 and 20-3 are fitted in and fastened to the slots 23 of the two holders 21-1 and 21-3 by means of a plurality of rivets 26.

The second holder 21-2 is provided with the similar bifurcated rod 24 and one pair of cylindrical bearing retainers 25-3 and 25-4 which are formed to project from the portions equidistantly spaced from the two ends thereof.

In the respective bearing retainers 25-1 to 25-6 of the first to third holders 21-1 to 21-3, there are retained the aforementioned needle bearings 21-1 to 21-6, each of which has both its ends retained in both the ends of the corresponding one of the bearing retainers 25-1 to 25-6.

The first and third holders 21-1 and 21-3 are borne in a relationship of point symmetry to the vane shaft 2. Between the two bearing retainers 25-1 and 25-2 of the first holder 21-1, more specifically, there is positioned the intermediate bearing retainer 25-6 of the third holder 21-3 adjacent to the intermediate bearing retainer 25-2 of the first holder 21-1. The bearing retainer 25-5 at the end of the third holder 21-3 is positioned at the end portion of the first holder 21-1, where no bearing retainer exists. On the other hand, one bearing retainer 25-3 of the second holder 21-2 is positioned adjacent to the bearing retainer 25-1 at the end portion of the first holder 21-1 and the intermediate bearing retainer 25-6 of the third holder 21-3, and the other bearing retainer 25-4 thereof is positioned adjacent to the intermediate bearing retainer 25-2 of the first holder 21-1 and the bearing retainer 25-5 at the end portion of the third holder 21-3. Thrust bearings 27 are positioned between the adjacent bearing retainers 25-1 to 25-6.

On the bearing retainers 25-1 to 25-6, there are fixed balance weights W1 to W6 which protrude in the directions opposite to the first to third vanes 20-1 to 20-3. The rotational balance of the vanes 20-1 to 20-3 are ensured by those balance weights W1 to W6. The leading ends of the individual vanes 20-1 to 20-3 extend through the slots 19 in the rotor 7 and engage the inner circumference of the casing 1 such that they protrude from the outer circumference of the rotor 7, as the rotor 7 rotates, to slide on the inner circumference of the casing 1 in the circumferential direction.

The inner circumference of the casing 1 is formed across the land 15 with the exit 32 of a suction chamber 31 and the entrance 34 of a discharge chamber 33. Indicated at reference numerals 35 and 36 are the entrance of the suction chamber 31 and the exit of the discharge chamber 33, which have communications with the suction port and the discharge port.

Figure 3:
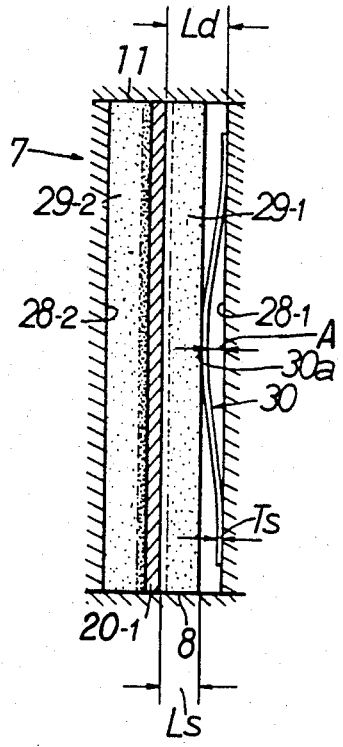
FIG. 3 is a sectional plan view taken substantially on the line III—III in FIG. 2.
Figure 4:
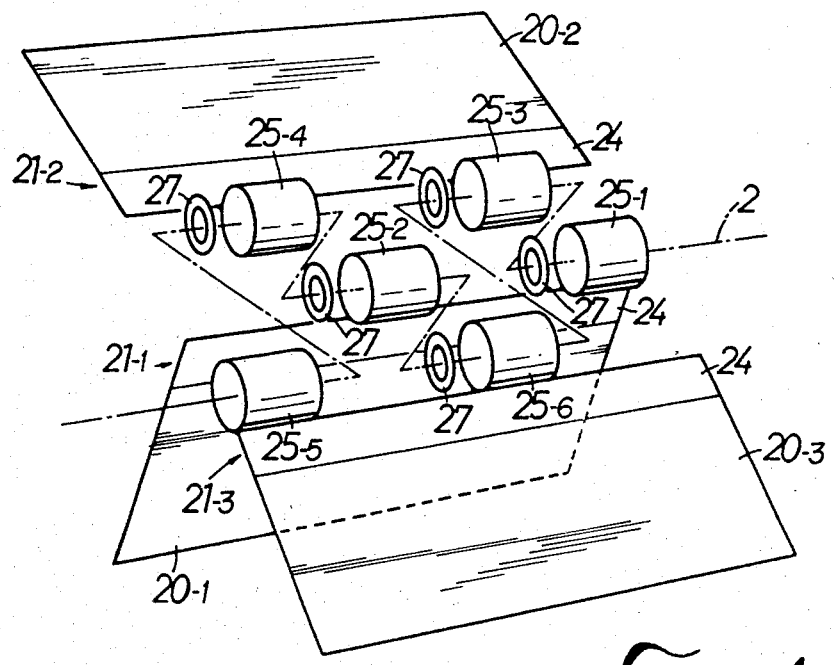
FIG. 4 is a perspective view schematically illustrating the arrangement of the individual vanes relative to the vane shaft.

Each slot 19 is formed in both its inner sides with long grooves 28-1 and 28-2 which have their openings facing each other and which are elongated in the longitudinal direction of the slot 19. Seal elements 29-1 and 29-2 made of carbon are fitted in the long grooves 28-1 and 28-2, respectively. Between the bottom of one long groove 28-1 positioned at the rotationally leading side of the rotor 7 and the seal element 29-1 in that groove, there is fitted under compression an angular leaf spring 30 which has a crest 30*a* at its longitudinal center portion, as shown in FIG. 3. The two seal elements 29-1 and 29-2 are forced into contact with both sides of each of the vanes 20-1 to 20-3 by the elastic force of that leaf spring 30.

The amplitude of the leaf spring 30 is shown by the letter "A" in FIG. 3 and specifically is equal to or less than 0.6 mm from the equation of $A=Ld-(Ls+Ts)$ by establishing the distance between the side of the first vane 20-1 and the bottom of the first long groove at $Ld \leqq 11.8$ mm, the thickness of the first seal element between the leading end and the leg portion at $Ls=10$ mm, and the thickness of the leaf spring 30 at $Ts=1.2$ mm. The width of the leaf spring 30, as shown in FIG. 3, is a width less than that of the groove bottom surface to allow the leaf spring to be flattened against the groove bottom surface.

The leaf spring 30 is preferably formed into an angular shape, as shown in FIG. 3 for the following reasons. If a strong impact or high-frequency vibration is exerted upon the first seal element 29-1 at the instant when each of the vanes 20-1 to 20-3 passes the entrance 34 of the discharge chamber 33, the leaf spring 30 is deformed to lower its crest 30*a* so as to absorb the impact or the vibrations. In such case, no inflection point is formed by that deflection if the leaf spring 30 has one crest. If the leaf spring 30 has two or more crests, for example, as shown in the aforementioned U.S. Pat. No. 2,625,112, an inflection point is formed in the bottom between the crests thereby adversely effecting the durability of the leaf spring 30.

The operations of the embodiment will be explained in the following. When the engine is run to drive the air pump, the rotor 7 is rotated in the direction a of FIG. 2. In accordance with these rotations, the individual vanes 21-1 to 20-3 slide on the inner circumference of the casing 1 with the length projecting from the outer circumference of the rotor 7 being gradually increased during the rotation of 180 degrees from the contacting position of the rotor 7 with the land 15. During the subsequent rotation of 180 degrees, the vanes 20-1 to 20-3 slide on the inner circumference of the casing 1 with their respective lengths projecting from the outer circumference of the rotor 7 being gradually decreased. As a result, the individual vanes 20-1 to 20-3 perform pumping actions in which they are caused to draw air from the exit 32 of the suction chamber 31, to carry the air around the inner circumference of the casing 1, and to discharge the carried air into the entrance 34 of the discharge chamber 33.

The aforementioned high impact is exerted upon each of the first seal elements 29 at the instant when each vane 20-1 to 20-3 passes the entrance 34 of the discharge chamber 36. Since the amplitude A of the leaf spring 30 is set below 0.6 mm, however, the moving stroke of each first seal element 29-1 is small. As a result, the impact applied to each first seal element 29-1 is weakened so that the seal element 29-1 can be prevented from being broken.

Figure 5:
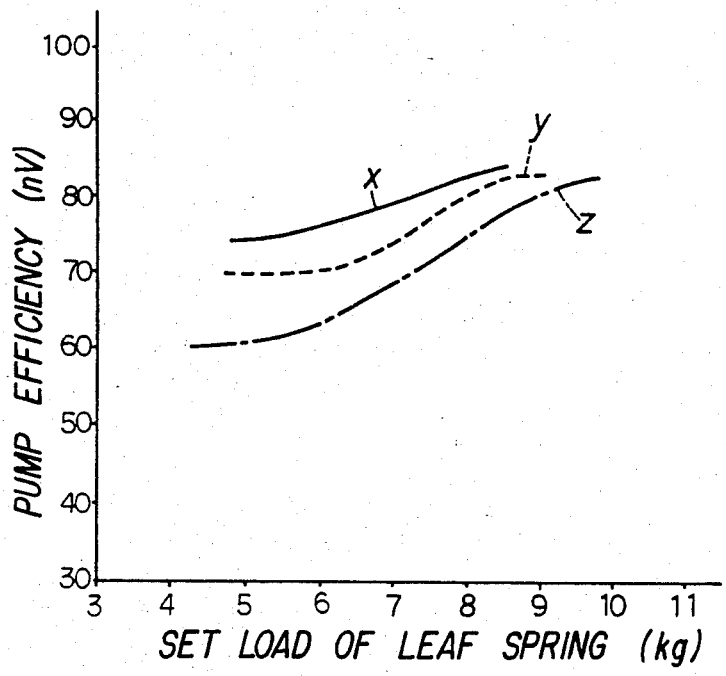
FIG. 5 is a graph illustrating the relationship between the pumping efficiency and the set load of the leaf spring.

As shown in FIG. 5, if the amplitude of the leaf spring 30 is set at 0.4 mm (i.e., curve x) and 0.6 mm (i.e., curve y) for the air pump having 6,000 r.p.m., the pumping efficiency is found to be improved better, even if the set load of the leaf spring 30 is common, than that in case the amplitude is set at 0.8 mm (i.e., curve z). This is because the gap between each of the vanes 20-1 to 20-3 and the second seal element 29-2 when compressed air is pumped can be reduced by setting the amplitude of the leaf spring 30 at a small value.

As has been described hereinbefore, according to the present invention, the amplitude of the angular leaf spring for forcing each seal element into contact with the corresponding vane is set at or below 0.6 mm so that the first seal element can be prevented from being broken while improving the pumping efficiency.

The invention claimed is:

1. A seal arrangement for a vane type pump wherein vanes extend through slots in a rotor with grooves on both inner sides of each slot and elongated sealing elements are positioned in each groove with a leaf spring in compression positioned behind one sealing element in a groove to bias that sealing element toward the vane and in turn the vane toward the other sealing element for sealing engagement by both sealing elements with the vane, the improvement comprising the pair of facing grooves at each slot having bottom surfaces spaced a distance such that the sum of the thickness of the two sealing elements, the vane and the leaf spring in the direction between said two groove bottom surfaces is less than said distance by an amount equal to or less than 0.6 mm, and wherein said leaf spring is of a width slightly less than said groove bottom surface to allow said leaf spring to be flattened against said groove bottom surface and is bowed in the middle to contact the sealing element with the ends flatly contacting the groove bottom surface.

2. The seal arrangement of claim 1 wherein said sealing elements are of a low tensile and bending strength.

3. A vane type air pump constructed of a cylindrical casing and a cylindrical rotor which has its rotational center line eccentric to the center line of said casing with vanes extending through slots formed in the circumferential wall of the rotor parallel with rotational center line, the vanes having their leading ends engaging the inner circumference of said casing in a manner to slide in the circumferential direction, first and second seal elements having their leading end portions facing the sides of the vanes have leg portions positioned in first and second long grooves formed in both inner sides of the slots in the longitudinal direction of the slots, and an angular leaf spring urging said seal elements into contact with each vane is under compression and positioned between the bottom of the first long groove which is located in the rotationally leading side of said rotor and the leg portion of said first seal element positioned in that first long groove, the improvement comprising, the components having thickness such that, $$A = Ld - (Ls + Ts),$$

wherein, A is the amplitude of said leaf spring, Ld is the distance between the side of said vane and the bottom of said first long groove, Ls is the thickness of said first seal element between the leading end and the leg portion and Ts is the thickness of said leaf spring, and the amplitude A is equal to or less than 0.6 mm, and said leaf spring is of a width slightly less than said groove bottom surface to allow said leaf spring to be flattened against said groove bottom surface and is bowed in the middle to contact the sealing element with the ends flatly contacting the groove bottom surface.

* * * * *